US008314748B2

(12) United States Patent
Ksienski et al.

(10) Patent No.: US 8,314,748 B2
(45) Date of Patent: Nov. 20, 2012

(54) HEPTAGONAL ANTENNA ARRAY

(75) Inventors: David A. Ksienski, Los Angeles, CA (US); Walter L. Bloss, Rancho Palos Verdes, CA (US); Eric K. Hall, II, Seal Beach, CA (US); James P. McKay, Hermosa Beach, CA (US)

(73) Assignee: The Aerospace Corporation, El Segundo, CA (US)

( * ) Notice: Subject to any disclaimer, the term of this patent is extended or adjusted under 35 U.S.C. 154(b) by 208 days.

(21) Appl. No.: 12/720,659

(22) Filed: Mar. 9, 2010

(65) Prior Publication Data

US 2011/0063178 A1 Mar. 17, 2011

Related U.S. Application Data

(63) Continuation-in-part of application No. 11/821,931, filed on Jun. 26, 2007, now Pat. No. 7,710,346.

(51) Int. Cl.
*H01Q 21/00* (2006.01)

(52) U.S. Cl. ..... 343/844; 343/705; 343/853; 244/172.6

(58) Field of Classification Search ..... 343/705, 343/754, 757, 844, 853, 912, 915; 244/172.6
See application file for complete search history.

(56) References Cited

U.S. PATENT DOCUMENTS

| | | | | |
|---|---|---|---|---|
| 3,754,267 | A * | 8/1973 | Walters et al. | 343/705 |
| 4,855,751 | A * | 8/1989 | Ingerson | 343/779 |
| 5,961,076 | A * | 10/1999 | Eller et al. | 244/171.6 |
| 5,963,182 | A * | 10/1999 | Bassily | 343/912 |
| 5,984,235 | A * | 11/1999 | Snowhook | 244/171.3 |
| 6,504,514 | B1 * | 1/2003 | Toland et al. | 343/781 P |
| 7,874,520 | B2 * | 1/2011 | McKinnon et al. | 244/171.8 |

* cited by examiner

*Primary Examiner* — Tho G Phan
(74) *Attorney, Agent, or Firm* — Paul D. Chancellor; Ocean Law

(57) ABSTRACT

An antenna system includes a heptagonal antenna array having one center antenna element and seven circumferentially surrounding antenna elements offering improved near and far sidelobe rejection, which is well suited for mechanically-gimbaled and time delayed electrical steering antenna applications.

2 Claims, 3 Drawing Sheets

HEPTAGONAL ANTENNA ARRAY SYSTEM

HEPTAGONAL ANTENNA ARRAY SYSTEM

HEPTAGONAL ANTENNA PERFORMANCE

HEPTAGONAL ANTENNA ARRAY

PRIORITY CLAIM

This patent application is a continuation-in-part of U.S. patent application Ser. No. 11/821,931 filed Jun. 26, 2007 now U.S. Pat. No. 7,710,346, and entitled HEPTAGONAL ANTENNA ARRAY SYSTEM.

STATEMENT OF GOVERNMENT INTEREST

The invention was made with Government support under contract No. FA8802-04-C-0001 by the Department of the Air Force. The Government has certain rights in the invention.

BACKGROUND OF THE INVENTION

1. Field of the Invention

The invention relates to the field of communication electrical antennas and antenna arrays. More particularly, the present invention relates to a heptagonal antenna array.

2. Discussion of the Related Art

A measure of performance of an antenna design is the sidelobe pattern levels relative to a main beam and is measured in negative decibels (−dB). The sidelobes are measured in −dB from peak gain of the main beam down to the peak gain of the sidelobes that are nearest to the main beam in angular position. The desirable decrease in the peak gain of the sidelobe beams relative to the peak gain of the main beam is referred to herein as sidelobe rejection.

Desirable high sidelobe rejection rejects unwanted interference and can further enhance imaging in an imaging application. Sidelobe rejection is a function of the steered offset angle for both by phasing or delaying. When steered off center, mechanical blockage and electrical signal interference affect the amount of sidelobe rejection. It is desirable, of course, that the sidelobe rejection remain high even when an antenna array is steered off center, which is well suited for antenna tracking applications and interference immunity.

Sidelobe rejection is determined in part by the array configuration. Sidelobe rejection can also be measured as a function of beam steering that provides an angular offset from the center Nadir panel boresight. For example, a signal arriving from a far field point arrives at an angle offset and the antenna main beam is mechanically or electrically steered in that direction of the angular offset. The antenna or antenna array can be steered toward the direction of a transceived signal.

The antenna array inherently provides a Nadir panel boresight extending from the center of the antenna. The Nadir panel boresight is the referenced of a null $\theta=0°$ angular offset. The boresight can be steered to point at various angles. Mechanically gimbaled steering provides a gimbaled boresight and electronically phased steering provides a delayed boresight.

The gimbal boresight and delayed boresight steering have been commonly used to point an antenna array during tracking of a space object. Gimbaled steering requires time delays to electrically align the antenna elements because the mechanical gimbaling introduces small time delays between the various antennas. These time delays have been removed completely using time delays.

With gimbal steering, the main beam is no longer aligned to the Nadir panel boresight, but is centered on the gimbaled boresight of an individual reflector, but requires time delays. With phase steering, the main beam is no longer centered on the Nadir panel boresight of an individual reflector, but is centered on delayed boresight, but requires phase shifters or time delays to align all the signals from all of the antennas in the array.

Curious in nature are configurations that provide maximum packing densities. For example, bees make hexagonal hives. Three sided, four sided, and six sided polygons offer maximum density with zero interpolygonal space when these like polygons are positioned juxtaposed.

Conventional arrays having small numbers of elements have been used. Circular antenna elements have long been arranged in arrays. Antenna arrays have also been configured for maximum density of antenna elements. Small antenna arrays are typically arranged in hexagonal or rectangular lattice configurations.

Typical arrays are rectangular arrays and the hexagonal arrays. For a small number of elements, the typical array is either a nine-element array or a seven-element array. The nine-element array is arranged in a rectangular pattern. The seven-element array is arranged in a hexagonal pattern.

The hexagonal pattern has six outer antenna circumferentially disposed about a center antenna. The rectangular array can be a 3×3 rectangular array. The hexagonal array includes one center antenna circumferentially surrounded by six antennas.

Because the antenna elements are circular, there will exist interelemental space between the antenna elements, but the exterior of array generally forms a polygon shape. The rectangular and hexagonal arrays have a minimum amount of interelemental space yet provide an exterior quasi polygonal perimeter offering very high, but slightly less than optimal packing density.

The gain pattern of the small array is a product of the array configuration and the element patterns. The symmetry of these arrangements provides for symmetrical antenna patterns although disadvantageously with high sidelobe levels. Repositioning element positions in a random manner is a well-known technique for reducing sidelobes for large numbers of elements.

Decreasing the interelemental space advantageously increases peak gain of the main beam and side lobes. The antennas are typically positioned to touch but not overlap with a desired minimal amount of interelemental space between the perimeters of the reflectors providing an overall exterior quasipolygonal perimeter.

Increasing the interelemental space in an antenna array disadvantageously decreases sidelobe rejection and increases the total physical area required for the same number and size of antennas.

The antenna arrays operate under various conditions, but typically have the center main beam projected through and along the center boresight having a plurality of sidelobe beams. Antenna arrays are specifically designed to capture main beam transceived signals in a main beam while disadvantageously capturing unwanted transceived sidelobe signals captured in sidelobe beams.

An antenna generates a main beam and several sidelobe beams that are circumferentially disposed about the main beam and extend from near to far from the main beam. Each antenna dish includes a feed horn that operates to provide a power taper from the feed horn to the perimeter of the dish. The power taper radially extending from the feed horn to the perimeter may be, for example, −10 dB.

Antenna steering can be by gimballing the array elements with electrical time delay phase steering or by sole electrical phase steering the array elements. Gimbal steering has been used for single antennas as well as for very large arrays. When Gimbal steering is used, phase steering is also used, preferably using time delays, so that the delaying boresight and the gimbal boresight are in coincident alignment.

With gimbaled steering, the difference between the gimbaled offset angle of phased offset angle are initially the same, but in some applications, the phase offset angle is dithered by a very small angular amount.

For example, the Nadir panel boresight can be referenced to θ=0°, while the gimbal boresight is moved to θ=10°, and the delayed boresight is dithered between θ=10° and θ=9° providing a 1° dither. Phased steering has been used for both planar phased arrays that do not use mechanical gimballing.

Conventional planar phase arrays use phase shifters and not time delays for phase steering because the number and costs of required expensive time delays as opposed to the inexpensive phase shifters. Other conventional dish arrays have used time delays for phase steering. Time delays are preferred to eliminate frequency dependencies of the sidelobe rejections, but are expensive for array with a large number of elements.

For example, a 1 GHz signal may be transceived by a 5 m diameter nine-element array. Each element has a −10 dB power taper. The sidelobe levels of the nine element rectangular array are −10 dB below the peak gain of the main beam at a zero offset. The rectangular array of nine reflectors can be mechanically and electrically steered to the center θ=0° with near sidelobes suppressed by −10 dB and with very far sidelobes suppressed by more than −25 dB at 1 GHz.

When the frequency is changed from 1 GHz to 0.7 GHz, the main beam and sidelobe peaks remain the same, with the main beam at the θ=0°, but the beams broaden in angular position. There are no frequency dependent grating lobes. The main beam is still positioned on the Nadir planar boresight.

When the offset angle is changed by steering, for example, from θ=0° to θ=10° off the Nadir planar boresight, by both mechanical and electrical steering, the sidelobe rejection remains the same. As such, the nine-element array can be steered mechanically and electrically to a single, frequency-independent, angular position without sidelobe rejection degradation, excepting for the slight loss associated with blockage by mechanical steering.

The peak gains of the sidelobes remain approximately the same over frequency and angular position. The angular position of the sidelobes relative to the main beam, however, scales with the operational frequency.

When the nine-element array is mechanically steered gimbaled to θ=10°, and is further electrically steered to between θ=9° and θ=10°, the sidelobes degradation is asymmetrical but with excellent far sidelobe rejection as the sidelobe degradation increases with offset angle. The same conditions can be applied to a 5 m diameter seven-element array.

The sidelobe rejection of the hexagonal array is −13.5 dB below the peak gain of the main beam at a zero offset. Far sidelobe rejection for the nine-element array is −7 dB at a half beamwidth from the center and −4 dB at one beamwidth from the center. Far sidelobe rejection for the seven-element array is −8.8 dB at a half beamwidth from the center and −4.4 dB at one beamwidth from the center.

The nine and seven element arrays provide broadening main and sidelobe beamwidths with frequency as the angular positions of these beams changes and scales with frequency. Identical mechanical and electrical steering offers no degradation of sidelobe rejection, and there are no frequency dependent grating lobes. However, nonidentical mechanical and electrical steering injects asymmetrical sidelobe rejection degradation with good far sidelobe rejection.

The sidelobe rejection of the nine-element rectangular array is −10 dB below the peak gain of the main beam at a zero offset. The sidelobe levels of the hexagonal array are −13.5 dB below the peak gain at a zero offset. Although the hexagonal array does offer improved performance of sidelobe suppression relative to the rectangular array, there are applications where sidelobe levels should be further reduced for improved performance.

Hence, it has been desirable to provide an optimal packing density antenna array with good sidelobe rejection when both mechanical and electrical steering are at the same offsets. However, current antenna arrays only offer modest sidelobe rejection. These and other disadvantages are solved or reduced using the invention.

SUMMARY OF THE INVENTION

An object of the invention is to provide an antenna array having increased sidelobe rejection.

Another object of the invention is to provide an antenna array having increased near and far sidelobe rejection and an antenna array having increased sidelobe rejection using mechanical and electrical steering.

Yet another object of the invention is to provide an antenna array having increased near and far sidelobe rejection and an antenna array having increased sidelobe rejection using only electrical steering.

Still another object of the invention is to provide a heptagonal antenna array having increased sidelobe rejection.

A further object of the invention is to provide a heptagonal antenna system having increased sidelobe rejection.

Yet a further object of the invention is to provide a heptagonal antenna system having increased near and far sidelobe rejection using mechanical gimbaled steering and delayed steering.

The invention is directed to a heptagon antenna array offering improved sidelobe rejection. For reasons not yet fully understood, an unexpected and surprising discovery was made that an eight element array, having one center element and seven exterior element circumferentially surrounding the center element, has superior sidelobe rejection performance, even with an increase in interelemental spacing. That is, sidelobe rejection is improved, surprisingly, in both the near and far sidelobes, yet the packing density has been modestly degraded over the hexagonal configuration. The system uses a heptagonal arrangement in an eight-element array. The suppression of the sidelobes relative to peak gain of the main beam has been improved to −15 dB. These and other advantages will become more apparent from the following detailed description of the preferred embodiment.

DETAILED DESCRIPTION OF THE INVENTION

Figure 1:
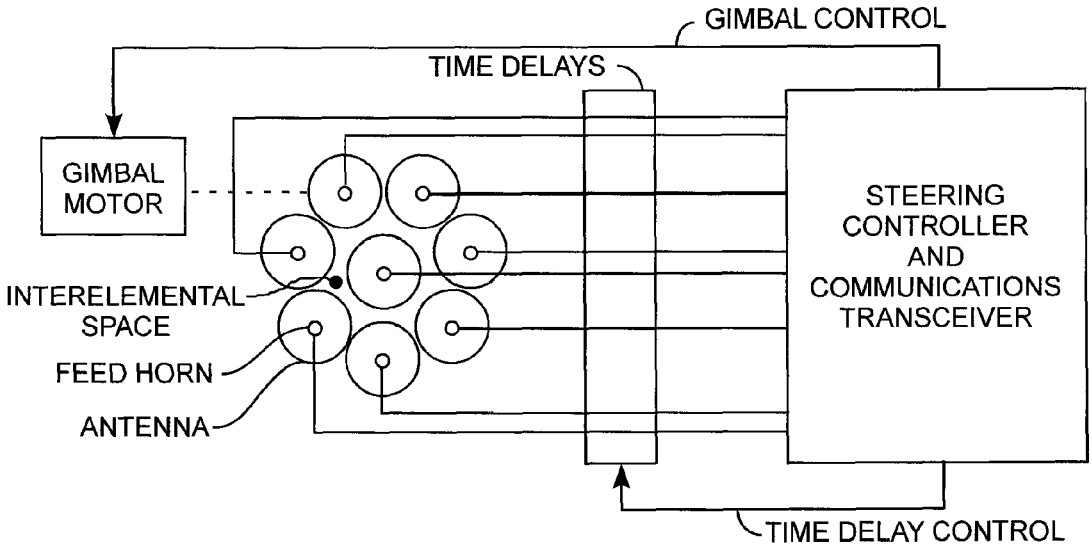
FIG. 1 is a block diagram of a heptagonal antenna array system.

An embodiment of the invention is described with reference to the figures using reference designations as shown in the figures. Referring to FIG. 1, a heptagonal antenna array includes a center antenna element with seven surrounding antenna elements.

Preferably, the seven surrounding elements are equiangularly disposed about the center antenna element. Preferably, the seven outer elements are in juxtaposed positions about the center element. As such, there is an interelemental space created between the center element and the outer elements, which interelemental space is disadvantageously, significantly increased.

A steering controller and communications transceiver is conventionally attached to the array. The seven outer reflectors are positioned in a circle so as to touch, but do not overlap. There is equal separation between the innermost reflector and each of the outer reflectors. Preferably, the eight elements are identical reflector dish antennas, each having a respective feed horn for transponding signals with the transceiver.

The controller provides gimbal control signals to gimbal motors for gimbaled steering and pointing of the array. Between the array and the transceiver are electrical steering elements, which can be phase shifters, but are preferably time delays.

The transceiver may include solid state power amplifiers to transceive signals through the feed horns. The communications transceiver provides time delay control signals to the time delays for electrically steering the array. The array is preferably steered by both mechanical gimballing and electrical time delaying, both well understood in those skilled in the art.

Figure 2:
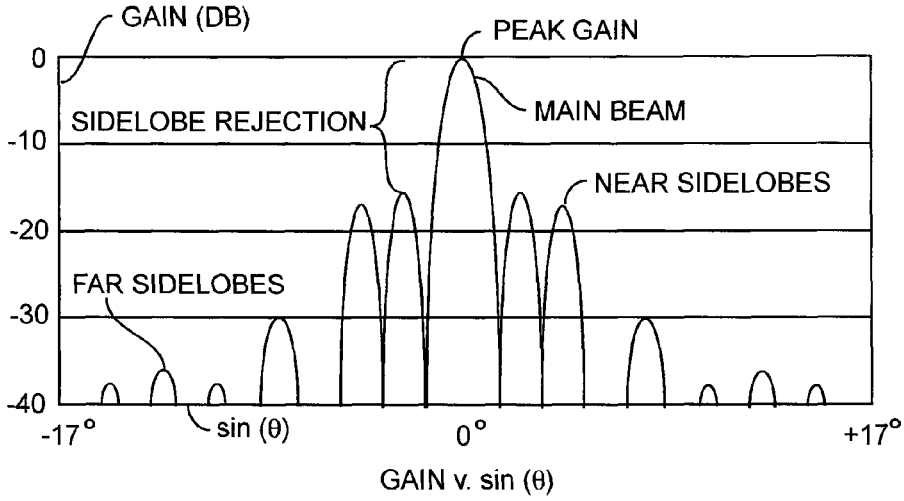
FIG. 2 is a plot of the heptagonal antenna performance.

Referring to FIGS. 1 and 2, and more particularly to FIG. 2, the heptagonal array provides improved performance with enhanced near and far sidelobe rejection. The heptagonal array achieves suppression of the sidelobe level through a regular heptagonal distribution of antenna elements. The near sidelobe rejection is reduced to −15 dB below the peak gain of the main beam. Sidelobe rejection for this eight-element array is −11.8 dB when the beam is electrically steered to a half beamwidth from the center and −8.4 dB when the beam is electrically steered to one beamwidth from the center.

Main beam beamwidths and sidelobe beamwidths narrow with frequency as the angular positions of these beams change and scale with frequency. Identical mechanical and electrical steering offers no degradation of sidelobe rejection, and there are no frequency dependent grating lobes. Nonidentical mechanical and electrical steering injects asymmetrical sidelobe rejection degradation with good far sidelobe rejection.

This eight-element array facilitates substituting one large aperture with eight smaller subapertures, while presenting improved sidelobe performance. This is useful for space applications where a single large aperture can be much more expensive and riskier than eight apertures with about the same total area.

For example, resultant features particularly useful in space applications include improved antenna system amplifiers and launch vehicle fairings. Multiple smaller subapertures can, depending on application, enable a single traveling wave tube amplifier to be replaced by a collection of inexpensive and light in weight solid state amplifiers with a likely decrease in cost and risk.

Figure 3A:
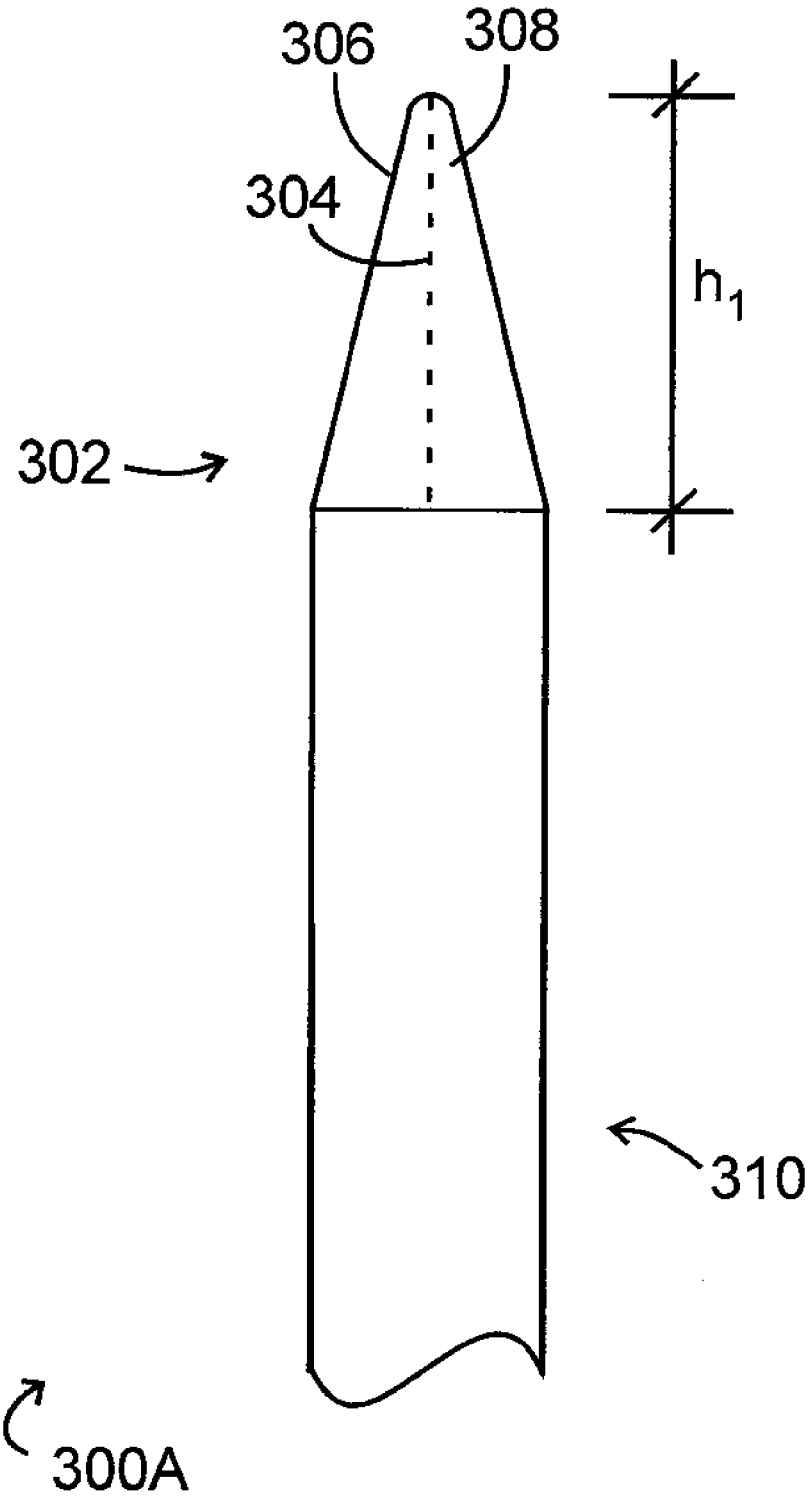
FIG. 3A-C show a spacecraft incorporating a multi-element antenna array.

Multiple smaller subapertures can also, depending on application, enable a large and/or tall fairing to be replaced by a smaller and/or shorter fairing reducing fairing weight and fairing subsystem weight. For example, FIG. 3A shows a rocket and stowed payload 300A. A rocket 310 supports an upper payload section 302 having a payload fairing. The fairing shown is a clamshell type fairing but may be another similar jetisonable or removable fairing. As shown, fairing first and second halves 306, 308 have a separable joint 304 providing for jettisoning the fairing at an appropriate time and place in a launch.

The height of the fairing h1 is determined by, among other things, the height of a payload beneath the fairing. Where the payload includes an antenna covered by the fairing, an antenna dimension such as antenna height can determine fairing height. Advantages of some embodiments of the present invention limiting fairing size are described below.

Figure 3B:
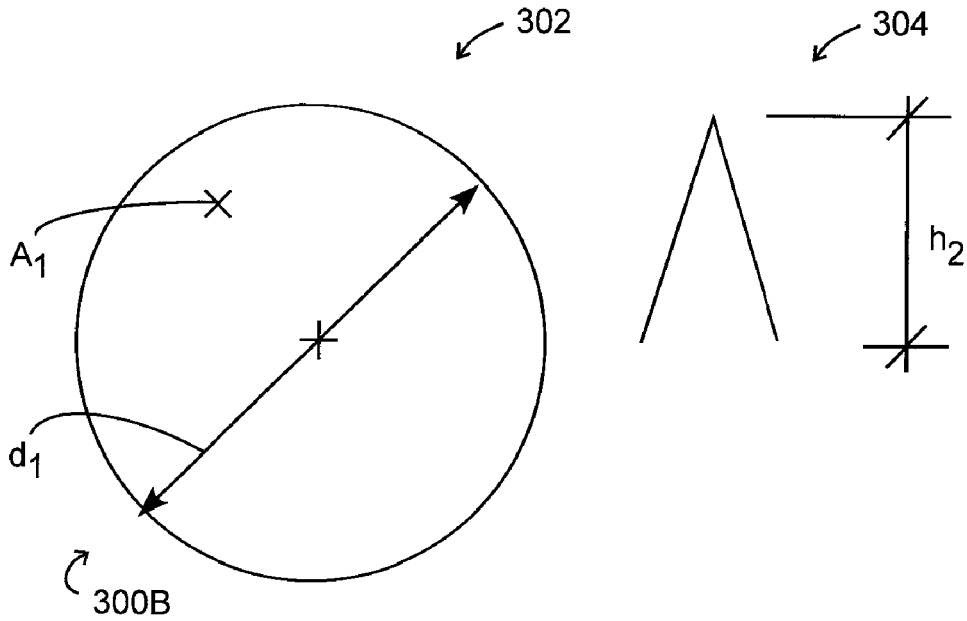
Figure 3C:
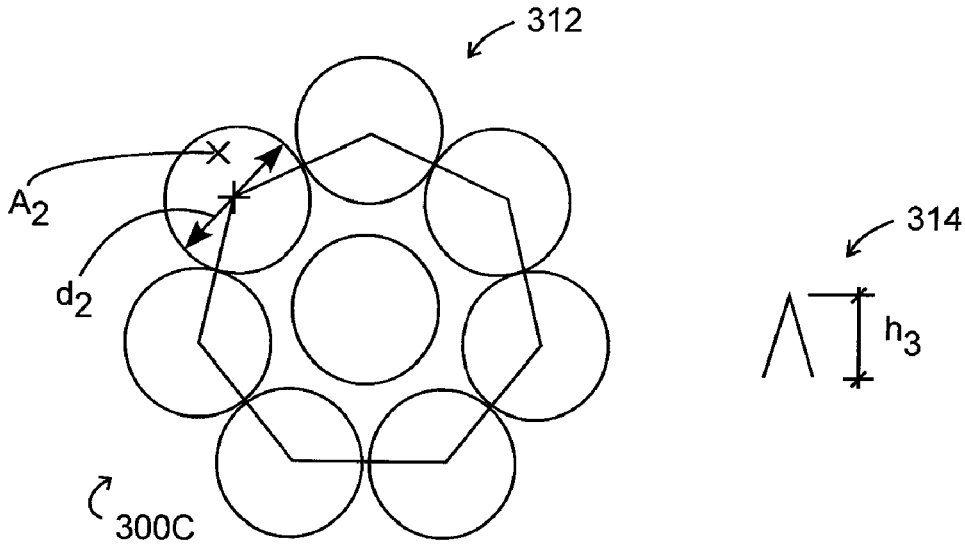

FIG. 3B shows a reflector of a single large antenna 300B having an area A1 and a diameter d1. FIG. 3C shows a heptagonal antenna arrangement 300C. In particular eight reflectors of eight smaller antennas 312 are shown, each antenna having an area A2 and a diameter d2. In some embodiments, the capability and/or gain of the large antenna can be substantially duplicated by the antenna array if the reflector areas are similar, such as where A1=8(A2).

For example, if the large antenna reflector has an area of 16 square meters, d1 is about 4.5 m and d2 is about 1.6 m. For non-collapsible antennas, it is seen that an antenna storage space dimension differs by a ratio of about 3:1. Similarly, if individual antennas have an umbrella like collapsible structure, 304, 314, their storage height becomes about h2=(4.2/2)m for the large antenna and about h3=(1.6/2)m for each of the smaller antennas. Again, the storage space dimension differs by an approximate ratio of 3:1. Some embodiments of the present invention therefore reduce one or more of fairing height, weight, cost, and fairing deployment related risks.

Finally, the heptagonal array appears to exhibit superior performance with both mechanical and electrical angular scanning across the field of view, relative to the seven-element hexagonal array and the nine-element square array. The sidelobe rejections have been verified numerically for small dither angles.

The improved sidelobe rejection during mechanical steering may result from reduced and randomized blockage of the individual elements, and this originates with the increased separation from the center element as well as the distributed angular location of the blockage for each element. When a nine-element array is mechanically steered, six of the elements will have blockage on a side of the reflector. When the eight-element heptagonal array is scanned along in the same direction, the amount of blockage will be relatively less due to the interelemental separation from the center element. This blockage will occur at a different angular position for each element. The pattern of the array benefits from the randomization of the blockage of the individual elements.

The invention is directed to achieving improved sidelobe suppression using a heptagonal array configuration. Nearest sidelobe rejection has been increased to −15 dB. The heptagonal array can be a low-cost alternative to a traditional single, contiguous large aperture antenna.

For space based applications, the cost can be less than a single reflector with a single feed, but requiring costs of deployment and gimballing. Subarray steering was by electronic steering, but without frequency dependent grating lobes.

The heptagonal array can reduce losses due to mechanical steering. The heptagonal array can have instantaneous electronic steering with single-beamwidth repositioning. Further, there is no sidelobe degradation when the reflectors are electrically and mechanically steered to the same angular coordinates.

Those skilled in the art can make enhancements, improvements, and modifications to the invention, and these enhancements, improvements, and modifications may nonetheless fall within the spirit and scope of the following claims.

What is claimed is:

1. A method of limiting the size of a spacecraft fairing covering a stowed antenna while increasing the performance of the antenna after the fairing is removed and the antenna is deployed, the method comprising the steps of:

selecting an antenna gain;

designing an antenna element array in accordance with the selected antenna gain, the deployed antenna element array consisting of one central antenna element and seven surrounding antenna elements;

designing a mechanically-gimbaled steering system and time delayed electrical steering system for steering the antenna elements; and, designing a fairing for covering the stowed antenna element array in accordance with the size of individual antenna array elements.

2. A method of optimizing the performance of a spacecraft antenna that will be deployed after a fairing is removed, the fairing having known dimensions, the method comprising the steps of:

for given fairing dimensions, designing an antenna array element reflector to be deployed after the fairing is removed;

designing an antenna array utilizing eight of the reflectors, the antenna array consisting of one central antenna element and seven surrounding antenna elements; and, designing a mechanically-gimbaled and time delayed electrical steering system for steering the antenna elements.

* * * * *